US007636958B2

(12) United States Patent
Nichols-Roy et al.

(10) Patent No.: US 7,636,958 B2
(45) Date of Patent: Dec. 29, 2009

(54) FLUSH VALVE WITH ADJUSTABLE OVERFLOW TUBE AND METHOD FOR INSTALLING A TOILET VALVE

(75) Inventors: David Nichols-Roy, Escondido, CA (US); Alberto C. Torres, Hemet, CA (US)

(73) Assignee: Lavelle Industries, Inc., Burlington, WI (US)

( * ) Notice: Subject to any disclaimer, the term of this patent is extended or adjusted under 35 U.S.C. 154(b) by 467 days.

(21) Appl. No.: 11/096,508

(22) Filed: Apr. 1, 2005

(65) Prior Publication Data

US 2006/0218712 A1 Oct. 5, 2006

(51) Int. Cl.
*E03D 1/34* (2006.01)

(52) U.S. Cl. ..... 4/378; 4/393

(58) Field of Classification Search ..... 4/324–326, 4/353, 378, 379, 381–384, 390–395, 404
See application file for complete search history.

(56) References Cited

U.S. PATENT DOCUMENTS

| | | | | |
|---|---|---|---|---|
| 4,593,419 | A * | 6/1986 | Derus | 4/324 |
| 5,325,544 | A * | 7/1994 | Busch | 4/213 |
| 5,754,986 | A * | 5/1998 | Chien | 4/327 |
| 6,438,767 | B1 * | 8/2002 | Warshawsky | 4/567 |
| 6,484,327 | B2 * | 11/2002 | Hand | 4/326 |
| 7,216,373 | B2 * | 5/2007 | Huang | 4/393 |

* cited by examiner

*Primary Examiner*—Tuan N Nguyen
(74) *Attorney, Agent, or Firm*—Joseph S. Heino; Patrick M. Bergin

(57) ABSTRACT

The present invention provides an improved top mounted toilet flush valve and a method for installing the flush valve that can be readily adapted to the tank profile of a wide variety of gravity operated flush toilets. More specifically, in accordance with the objectives of the present invention, there is provided a flush valve having an overflow tube that is adjustable in height and a method for adjusting the overflow tube.

17 Claims, 2 Drawing Sheets

FLUSH VALVE WITH ADJUSTABLE OVERFLOW TUBE AND METHOD FOR INSTALLING A TOILET VALVE

FIELD OF THE INVENTION

The present invention relates generally to plumbing fixtures. More particularly, it relates to a flush valve that includes a height-adjustable overflow tube to allow for proper setting of the overflow tube in relation to the height of the water contained within a toilet tank, which height varies between products and designs.

BACKGROUND OF THE INVENTION

A conventional gravity operated flush toilet has several basic components. The china components include a porcelain bowl and a porcelain tank mounted on top of the bowl. The bowl and tank may either be separate pieces or may be molded as a single unitary piece of china. The plumbing components of a conventional gravity operated flush toilet include a fill valve in the tank that is connected to a water supply line, a flush valve mounted in a hole in the bottom wall of the tank that communicates with the bowl, a flapper valve that normally closes the flush valve, and a lever or push button on the outer wall of the tank that is connected with a chain or other mechanical linkage for momentarily lifting of the flapper valve. This allows water stored in the tank to flow rapidly through the flush valve into the bowl to carry waste along with the water through a trap connected to the underside of the bowl and into a waste pipe connected to a sewer line, septic tank or other waste reservoir.

Conventional flush valves for gravity operated toilets are generally cylindrical and provide a round valve seat for the flapper valve. They are secured in a drain hole in the bottom wall of the toilet tank from underneath the bottom wall. Typically a large nut is screwed over a male threaded lower portion of the cylindrical flush valve body, on the underside of the bottom wall of the tank. Extending upwardly from the flush valve body is a cylindrical overflow tube. The purpose of the overflow tube is to ensure that a proper water level is maintained within the toilet tank. Ideally, the inlet of the overflow tube is set at a point where it is slightly above normal water level but below the bottom of the flush lever nut that is located on a vertical wall of the tank for actuation of the flushing cycle.

In the United States, there are two basic markets for toilet flush valves, namely, the original equipment manufacturer (OEM) market and the after-installation market. The former consists of large toilet manufacturers that assemble and sell complete gravity operated flush toilets including flush valves. The latter consists of hardware and plumbing supply stores that sell to plumbers and home owners for repair and replacement in toilets already installed in residences.

Every gravity operated flush toilet has an optimum fill level that ensures that enough water is in the tank for proper flushing without wasting water or risking incomplete waste carry out. For many years, gravity operated flush toilets in the United States had tanks with capacities of three and one-half, five gallons, or more. More recently, the Environmental Protection Agency (EPA) has mandated that low water consumption toilets be installed in all new construction and during all re-models, with a maximum water usage of 1.6 gallons per flush. Both the older high volume gravity operated flush toilets and the newer low volume gravity operated flush toilets come in a wide range of tank configurations with different optimum fill levels. Because of this, installation of after-installation market flush valves, which are manufactured in a pre-determined height to accommodate the deepest tank depth likely to be found, typically requires the installer to hand cut the overflow tube of the flush valve to fit. In the experience of this inventor, it would be unduly expensive to manufacture a variety of different overflow valves, each having an overflow tube of different height, to satisfy the configurations of the various gravity operated flush toilets manufactured in the United States and abroad. It is, therefore, advantageous to provide an after-installation flush valve having an adjustable overflow tube that permits plumbers and do-it-yourself homeowners to install the flush valve and to quickly, easily, and without tools, adjust the height of its overflow tube as necessary.

SUMMARY OF THE INVENTION

Accordingly, a primary objective of the device of the present invention is to provide an improved flush valve for the after market that can be readily adapted to the tank profile of a wide variety of gravity operated flush toilets. A further object of the invention is to provide an increase in the surface area of the opening of the overflow tube by flaring the upper end of the overflow tube such that the overflow tube permits 10 or more gallons/minute. It is an additional object of the present invention to provide a clip mechanism that cooperates with a plurality of ribs on the flared end of the overflow tube. In accordance with the aforementioned objectives of the present invention, there is provided a flush valve having an overflow tube that is adjustable in height. The foregoing and other features of the apparatus of the present invention will be apparent from the detailed description that follows.

DETAILED DESCRIPTION

Figure 1:
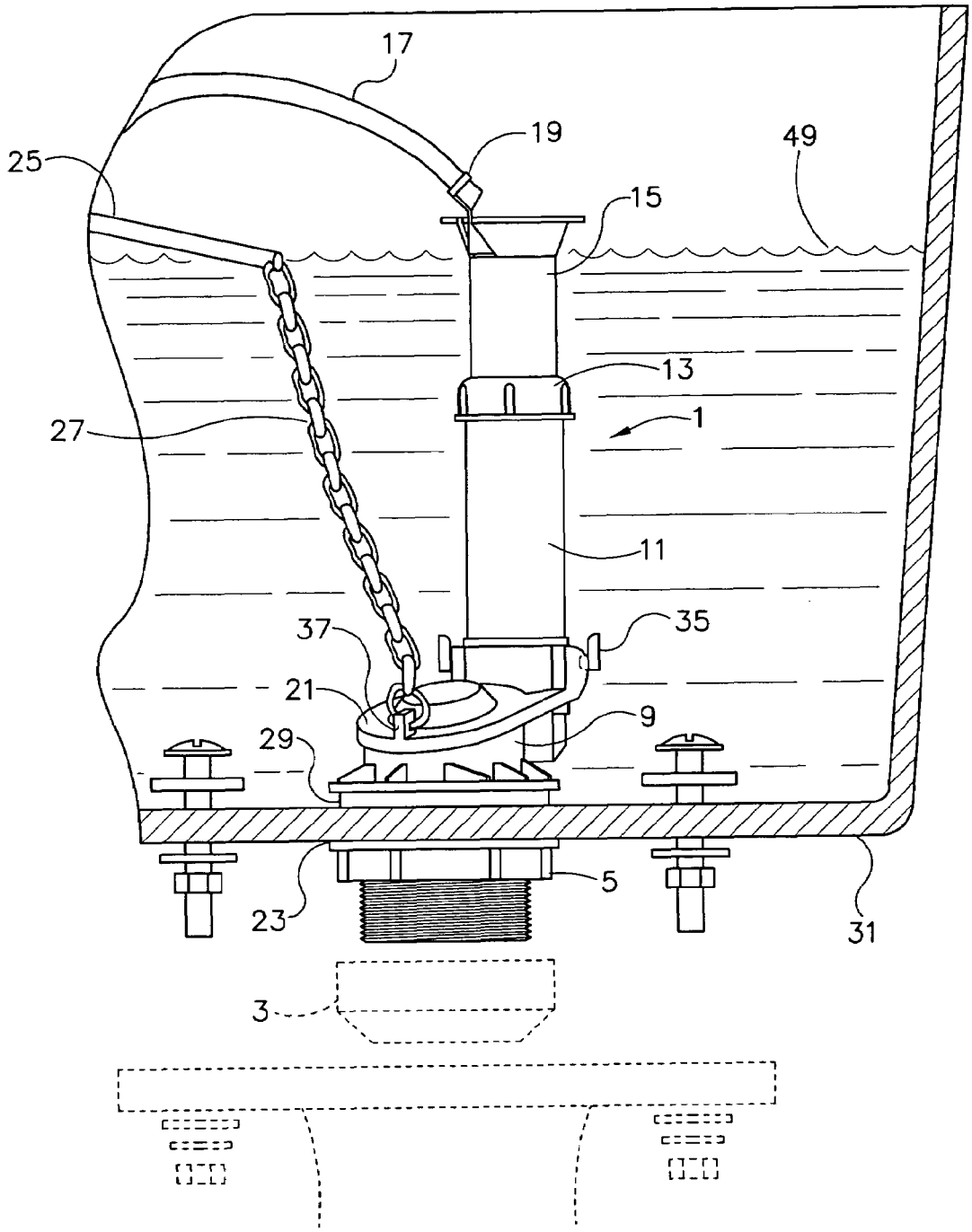
FIG. 1 is front elevational view of the flush valve with an adjustable overflow tube of the present invention shown installed in a toilet tank.

Referring now to the drawings in detail, wherein like-numbered elements refer to like elements throughout, FIG. 1 illustrates the flush valve 1 of the present invention as it would be installed in a toilet tank 31. Specifically, FIG. 1 shows a toilet tank 31 mountable to the rearward portion of a toilet seat (toilet seat is shown in phantom view). The toilet tank 31 is mounted to the toilet seat using mounting bolts 47 and the flush valve 1 is inserted through the drainhole 7 of the toilet tank 31 into the toilet seat. FIG. 1 also shows the water level 49 in a toilet tank 31, which is below the top of the overflow tube 15. In normal operation, to flush the toilet, the lever on the outside of the toilet tank 31 would be moved, typically downwardly, thus actuating the lever 25 in the toilet tank 31 and lifting the flapper chain 27 and flapper valve 21, thereby emptying the contents of the toilet tank 31 and flushing the toilet. After a flush occurs, the flapper valve 21 closes permitting the toilet to fill. Normally, the flow of water into the toilet is governed by a toilet fill valve or ballcock (not shown). In the event the toilet fill valve malfunctions and fails to shut off the flow of water to the toilet tank 31, the overflow tube 15 provides an outlet for the excess water in the tank by providing passage down the overflow tubes, 15, 11 (i.e. the upper tube 15 and lower tube 11) and through the passage through the valve body 9.

Figure 2:
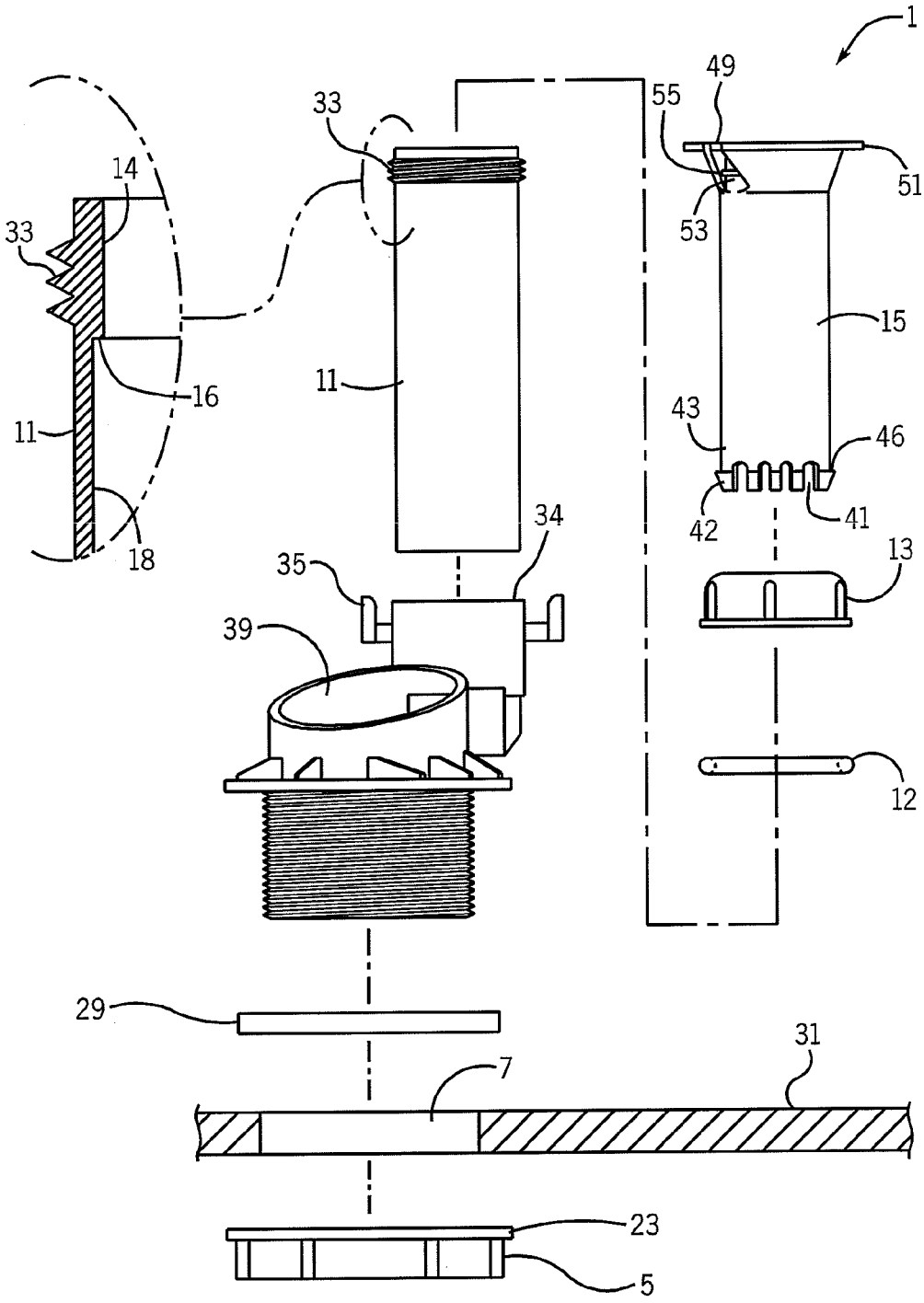
FIG. 2 is an enlarged front exploded elevational view of the flush valve illustrated in FIG. 1.

FIG. 2 shows an exploded view of the assembly of the adjustable-height flush valve 1. Referring back to FIG. 1, and starting from the base of the toilet and moving upwardly, items that may be included in the commercial embodiment of the replacement flush valve include a sponge gasket 3, a mounting nut 5, a chipboard washer 23 between the toilet tank 31 and the mounting nut 5, and a rubber seal 29 between the valve body 9 and the toilet tank 31.

The washer 23 is a donut-shaped piece of elastomeric material which is both resilient and deformable. Suitable materials for the washer 23 include, but are not limited to, chipboard or polyethylene. The chipboard washer 23 is used to reduce the friction between the mounting nut 5 and the toilet tank 31, making it easier to tighten the mounting nut 5 by hand.

The valve body 9 is formed with a passage (not shown) adjacent to the aperture 39. The valve body 9 includes flapper valve mounts 35 situated on either side of the valve body 9 for mounting the rubber flapper valve 21. The flapper valve 21 also includes a flapper chain eyelet 37. The flapper chain eyelet 37 permits attachment of a flapper chain 27, attached to lever 25. The rubber flapper valve 21 covers the aperture 39 in the valve body 9 when the toilet is not being flushed. The lever 25 is actuated by the toilet handle (not pictured) to pull the flapper chain 27 and open the flapper valve 21 and evacuate the contents of the toilet tank 31, thus flushing the toilet.

The valve body 9 also has a first length of overflow tube 11 and a second length of overflow tube 15. The first length of overflow tube 11 may be an integral part of the valve body 9 or may be a separate part that attaches to the valve body 9. The first length of overflow tube 11 has been shown in FIG. 2 as a separate part. In this case, the first length of overflow tube 11 would fit into a complementary aperture 34 of the valve body 9. A simple press fit would be acceptable, although other types of retaining means could also be used. In a first embodiment, the second length of overflow tube 15 fits slidably into the first length of overflow tube 11. The top of the first length of overflow tube 11 is externally threaded 33. A locknut 13 having complementary internal threads (not shown) threads onto the threaded portion 33 of the first length of overflow tube 11 with a sealing O-ring 12 disposed between them. The first length of overflow tube 11 also includes a first circumferential inner wall surface 14 that is disposed at the uppermost end of the first length of overflow tube 11 and a second circumferential inner wall surface 18 that is disposed below the first inner wall surface 14. The first circumferential inner wall surface 14 has a diameter that is smaller than the diameter of the second circumferential inner wall surface 18. The difference in the inner diameters of those surfaces 14, 18 creates a circumferential inner ledge 16 which provides a "catch" or retaining means for the second length of overflow tube 15. In this configuration, the position of the second length of overflow tube 15 is generally vertically "adjustable" relative to the first length of overflow tube 11.

The second length of overflow tube 15 has a plurality of fingers 42 and a plurality of retaining lips 46 disposed at the bottom 43 of the tube 15. That is, a retaining lip 46 is disposed on each finger 42 at the bottom 43 of the tube 15 and each finger 42 is separated by a notch 41, the notches 41 allowing the fingers 42 to flex slightly inwardly when the second length of overflow tube 15 is inserted into the first length of overflow tube 11 and along the first inner wall surface 14 of that first length of overflow tube 11. Once the second length of overflow tube 15 is inserted sufficiently into the first length of overflow tube 11, past the ledge 16 and along the second inner wall surface 18 of the first length of overflow tube 11, the retaining lip 46 of each finger 42 is configured to "catch" the ledge 16 on the inside of the first length of overflow tube 11 such that the adjustable second length of overflow tube 15 cannot easily be pulled out of the first length of overflow tube 11. That is, during insertion of the second length of overflow tube 15 into the first length of overflow tube 11, each lip 46 of each finger 42 effectively "snaps" outwardly as it passes over the ledge 16. In this fashion, the second length of overflow tube 15. though still vertically "adjustable" as described above, is limited in its upward movement by the presence of the ledge 16 and the fact that each lip 46 is "caught" at the ledge 16.

Additionally, the adjustable overflow tube 15 of the present invention has one end having a notched appearance 41. The notches 41 provide a degree of flexibility in the overflow tube 15 which permits the user of the of the overflow tube 15 to insert it into the first overflow tube 11 and move it within the tube so as to adjust the height of the overflow tube 15. When the adjustable overflow tube 15 is located at the desired height, the locknut 13 is tightened. Tightening or turning the locknut clockwise locknut 13 compresses the radial seal 12 against the outside of the overflow tube 15, thus locking the overflow tube 15 to the first overflow tube 11 to hold the adjustable overflow tube 15 in relative position to the first overflow tube 11.

The upper end of the adjustable overflow tube 15 is flared 51 such that it provides a larger surface area to admit water in the event of an overflow of water. Additionally, the upper end of the overflow tube provides a gap 49 in the flared overflow tube 15 that provides a latching point for the refill tube clip 19, discussed below. The gap 49 provides, in general, a flat surface 53 interrupted by a ridge 55. The ridge provides a surface for attaching the refill tube clip 19.

Preferably, the various parts of the flush valve 9 and the overflow tubes 11, 15 are injection molded using a suitable plastic such as ABS (Trademark) plastic or glass filled polypropylene. However, none of the above materials are considered a limitation of the invention. A wide variety of other suitable, durable and low cost materials for injection molding are also available.

The present invention also provides a method for fitting any sized toilet tank 31 with a universal flush valve 1 having an adjustable height overflow tube 15. In general, the water supply to the toilet should be turned off and the toilet tank 31 should be emptied. Secondly, the tank should be unbolted form the toilet bowl. Continuing, the existing flush valve should be removed and the new flush valve installed. First a rubber seal 29 is placed over the threaded end of the valve body 9. The threaded end of the valve body 9 is then inserted through the drainhole 7 in the toilet tank 31. A friction reducing washer 23 is then placed over the threaded end of the valve body 9 and a mounting nut 5 is threaded onto the valve body 9 to secure the valve body 9 to the toilet tank 21. A sponge gasket 3 is then placed over the mounting nut 5. The toilet tank 31 is then reattached to the bowl. Importantly, the height of the adjustable overflow tube 15 is then adjusted relative to the toilet tank. To adjust the height of the flush valve overflow tube 15, loosen the locknut 13 and extend the adjustable overflow tube 15 to the appropriate level. Next, tighten the locknut 13 and attach the refill tube 17 to the top of the adjustable overflow tube 15 using the refill tube clip 19. The refill tube clip 19 can take a variety of forms, but in one particular embodiment features a plurality of prongs which extend downwardly on the inside and the outside of the overflow tube 15 in the gap 49 of the flare 51 of the overflow tube 15. The prongs on the outside of the overflow tube 15 further have a notch slightly larger than the ridge 55 in the gap 49 such that the clip 19 is securely attached to the overflow tube 15.

Although the foregoing has been described with a certain degree of particularity, it is to be understood that the present disclosure has been made by way of example only and that numerous changes in the construction and the arrangement of components, some of which have been alluded to, may be resorted to without departing from the spirit and scope of the invention as it is described.

From the foregoing detailed description of the illustrative embodiment of the invention set forth herein, it will be apparent that there has been provided a new, useful and uncomplicated toilet flush valve having a variably adjustable overflow tube.

What is claimed is:

1. A toilet tank flush valve, comprising:

a valve body;

a valve mounted in the valve body; and a height adjustable overflow tube connected to the valve body, the height adjustable overflow tube comprising a first length of overflow tube having an upper-most portion, an externally threaded top disposed at the upper-most portion, a first circumferential inner wall surface that is disposed at the upper-most portion, a second circumferential inner wall surface that is disposed below the first inner wall surface, and a circumferential inner ledge disposed between the first inner wall surface and the second wall surface; a second length of overflow tube having a bottom, a plurality of fingers, adjacent fingers being separated by a notch and the notches allowing the fingers to flex inwardly, and each finger having a retaining lip for capturing the ledge when the second length of overflow tube is inserted into the first length of overflow tube; and a locknut that, when tightened, locks the second length of overflow tube in place relative to the first length.

2. The toilet tank flush valve of claim 1, the valve body having a passage therethrough having an aperture.

3. The toilet tank flush valve of claim 1, the valve body having a pair of flapper valve mounts.

4. The toilet tank flush valve of claim 3, the aperture in the valve body being covered by a flapper valve, the flapper pivoting on the flapper valve mounts.

5. The toilet tank flush valve of claim 4, the flapper valve further comprising a flapper chain mount, the flapper chain mount providing a attachment point for a flapper chain.

6. The toilet tank flush valve of claim 5 wherein the second length of overflow tube comprises an upper portion and such upper portion is flared outwardly to provide more surface area.

7. The toilet tank flush valve of claim 6 wherein the outward flare of the upper portion of the second length of overflow tube is interrupted by a gap, the gap providing a ridge for secure mounting of the refill tube clip.

8. A height adjustable toilet tank flush valve assembly comprising:

a valve body having an aperture, the valve body further being formed with a passage therethrough, the passage providing an aperture;

a first section of overflow tube having a bottom end being sized to fit within the passage aperture in the valve body and having a second end having a threaded top and an internal circumferential ledge;

a second section of overflow tube having a notched bottom, the notched bottom comprising a plurality of fingers, adjacent fingers being separated by a notch and the notches allowing the fingers to be resiliently compressible inwardly of the tube, and each finger having a retaining lip for capturing the ledge when the second section of overflow tube is inserted into the first section of overflow tube such that the first section of overflow tube compresses and snaps the fingers of the notched bottom outwardly into the first section of overflow tube and wherein the notched bottom is retained by the ledge in the first section of overflow tube such that the second section of overflow tube cannot be removed from the first section;

a sealing member interposed between the first section of overflow tube and the second section of overflow tube; and a locknut that, when tightened, locks the second section of overflow tube in place relative to the first section.

9. The toilet tank flush valve assembly of claim 8 wherein the valve body fits into the drainhole of a toilet tank.

10. The toilet tank flush valve assembly of claim 9 wherein a locknut threads onto the valve body on the outside of the toilet tank to secure the valve body to the toilet tank.

11. The toilet tank flush valve assembly of claim 10 wherein the second section of overflow tube comprises an upper portion and the upper portion widens circumferentially to create a larger orifice.

12. The toilet tank flush valve assembly of claim 11 wherein the widened upper portion of the second overflow tube is interrupted by a gap, the gap providing a ridge for secure mounting of the refill tube clip.

13. A height adjustable flush valve for a two-piece toilet, the toilet having a tank with a drainhole; the adjustable flush valve comprising:

a valve body with an integral overflow tube, the valve body being the valve body being formed with a passage therethrough complementary to the overflow tube, and an aperture, the overflow tube having a threaded top and an internal circumferential ledge;

a second section of overflow tube having a notched bottom that fits into the aperture of the integral overflow tube of the valve body, the notched bottom comprising a plurality of fingers, adjacent fingers being separated by a notch and the notches allowing the fingers to be resiliently compressible, and each finger having a retaining lip for capturing the ledge when the second section of overflow tube is inserted into the integral overflow tube of the valve body; and a locknut that, when tightened, locks the second section of overflow tube in place relative to the integral overflow tube of the valve body.

14. A method for installing a height adjustable flush valve in a toilet tank having an aperture at its base comprising the steps of:

providing a valve body having an aperture, a threaded end and a passage therethrough having an aperture;

inserting the flush valve into the aperture in the toilet tank;

placing a chipboard washer over the threaded end of the flush valve;

threading a mounting nut over the threaded end of the flush valve;

tightening the mounting nut to the base of the toilet;

providing an adjustable overflow tube comprising a first section of overflow tube having a threaded top and an internal circumferential ledge, a second length of overflow tube having a notched bottom, the notched bottom comprising a plurality of fingers, adjacent fingers being separated by a notch and the notches allowing the fingers to be resiliently compressible, and each finger having a retaining lip for capturing the ledge when the second section of overflow tube is inserted into the first section of overflow tube, and a locking nut;

inserting the adjustable overflow tube into the aperture of the flush valve;

adjusting the height of the overflow tube; and tightening the locknut to secure the second overflow tube in place.

15. The method of claim 14 including the step of placing a sponge gasket over the threaded end of the valve body on top of the mounting nut.

16. The method of claim 15 including the step of attaching a flapper valve to the valve body to cover the aperture.

17. The method of claim 16 including the step of attaching the flapper chain to a lever such that the flapper can be lifted, thus evacuating the contents of the toilet tank.

* * * * *